United States Patent [19]

Persson

[11] 4,147,209

[45] Apr. 3, 1979

[54] CORROSION RESISTANT HEAT EXCHANGER

[75] Inventor: Ake K. Persson, Hofors, Sweden

[73] Assignee: SKF Industrial Trading and Development Company B.V., Jutphaas, Netherlands

[21] Appl. No.: 825,983

[22] Filed: Aug. 19, 1977

Related U.S. Application Data

[63] Continuation of Ser. No. 608,210, Aug. 27, 1975, abandoned.

[51] Int. Cl.[2] ..... F28F 9/22

[52] U.S. Cl. ..... 165/161

[58] Field of Search ..... 165/159–161, 165/97, 110, 111; 122/32, 34; 432/223

[56] References Cited

U.S. PATENT DOCUMENTS

| | | | |
|---|---|---|---|
| 722,618 | 3/1903 | Richmand | 165/97 |
| 1,683,236 | 9/1928 | Brown | 165/160 |
| 1,992,796 | 2/1935 | Young et al. | 165/161 X |
| 3,147,743 | 9/1964 | Romanos | 165/158 |
| 3,702,633 | 11/1972 | Costhy | 165/159 |
| 3,989,105 | 11/1976 | Trehard | 165/162 |

FOREIGN PATENT DOCUMENTS

| | | | |
|---|---|---|---|
| 1092493 | 11/1960 | Fed. Rep. of Germany | 165/159 |
| 1137053 | 11/1960 | Fed. Rep. of Germany | 165/159 |
| 1501453 | 11/1969 | Fed. Rep. of Germany | 165/160 |

*Primary Examiner*—Charles J. Myhre
*Assistant Examiner*—Theophil W. Streule, Jr.
*Attorney, Agent, or Firm*—Daniel M. Rosen

[57] ABSTRACT

A metallic heat exchanger for heat transfer between a first medium flowing in tubes and a second medium flowing about the tubes and within an outer housing, the device including internal walls which divide the housing into three chambers with outlets and inlets to define a single continuous passage, the tubes extending through the chambers such that counter-flow heat exchange occurs in the first chamber, parallel flow heat exchange in the second chamber, and counter-flow heat exchange in the third chamber.

16 Claims, 3 Drawing Figures

CORROSION RESISTANT HEAT EXCHANGER

This is a continuation of application Ser. No. 608,210, filed Aug. 27, 1975 now abandoned.

BACKGROUND OF THE INVENTION

This invention relates generally to heat exchangers, and specifically to a metallic heat exchanger for transferring heat from a heat-emitting medium to a heat-absorbing medium through the walls of a number of flow tubes through which the one medium flows, these tubes being surrounded by the other medium. The heat exchanger is especially intended for use when preheating the combustion air for an oil-fired industrial furnace with its own flue gases.

A major problem with heat exchangers used for the purpose mentioned is the great danger of corrosion of those components of the heat exchanger exposed to high temperatures while simultaneously being in contact with the flue gases from the furnace. At temperatures above approximately 600° C., the material corrodes quite rapidly, mainly as a result of the action of sulfur oxides, vanadium oxides and alkali oxides contained in the fuel oil. In addition, the danger of corrosion is also great when the material temperature drops below approximately 150° C., this corrosion resulting mainly from the precipitation of acidic alkali sulfates on the heat exchanger surfaces. Furthermore, these corrosion products are adherent and lead to clogging of the gas channels.

The indicated problem occurs mainly in heat exchangers of the counterflow type, these providing the best heat utilization with the lowest possible heat transfer area. In heat exchangers of the parallel flow type, the danger of corrosion is low, but the heat utilization in such heat exchangers is limited in that the cold heat-absorbing medium cannot be heated to above approximately 100° C. below the outlet temperature of the hot heat-emitting medium.

To reduce the danger of high-temperature corrosion while simultaneously achieving a heat exchanger with small dimensions and satisfactory heat utilization, the simultaneous use of the parallel flow and counter-flow principles and, if possible, even combining these with the crossflow principle in one and the same heat exchanger is already known. In this case, the outlet for the cold medium is located adjacent to the inlet for the warm medium, where an initial heat exchange section is provided. After passing through this section, the cold medium is fed to a region adjacent to the outlet for the warm medium, where a second heat exchange section, of what is essentially the counter-flow type, is located. Generally, this section extends to the initial section.

Various embodiments of heat exchangers of this type are described, by way or example, in the U.S. Pat. No. 1,673,418 and in the German Pat. No. 1,551,553. The devices described in these publications have in common, complicated elements for generating the desired flow in the medium surrounding the flow tubes, this medium being preferably the cold medium. In addition, this medium flows for long distances without having contact with the walls of the flow tubes, resulting in complicated and expensive devices yielding a rather low heat utilization in relation to their size. Further, only some of the medium surrounding the flow tubes flows past the hottest section of these tubes. As a result when the amount of medium flowing through the heat exchanger is reduced, for example from a reduction in output of the furnace whose flue gases are being fed through the flow tubes of the heat exchanger concerned, the flow conditions for the cold medium become generally unfavorable so that overheating in the first heat transfer section results. In the second heat transfer section the cold medium can attain a higher temperature than intended, leading to high-temperature corrosion, or it can cool the warm medium too much, leding to low-temperature corrosion and a danger of clogging.

It is known further that radial or axial flanges can be attached to the outer surface of the flow tubes to control the flow of the medium surrounding these tubes in such a manner that a combination of the parallel flow and counterflow principles results, the entire flow of the medium surrounding the tubes thus passing through all of the various sections of the heat exchanger. A device of this type, for example, is shown in the German Patent No. 1.050.489, especially in FIG. 6. With such a design, one obtains a relatively compact embodiment of the heat exchanger, but the design is very complicated, especially with regard to the tubes, and assembly requires great precision. Any changes of the flow conditions in the cold medium require complete reconstruction of the entire heat exchanger.

SUMMARY OF THE INVENTION

The object of the present invention is to provide a heat exchanger, which provides good heat utilization but has only a low space requirement.

It is another object to provide a heat exchanger in accordance with the present invention, with an simple and inexpensive design, and with assembly being accomplished without difficulty. With simple modifications, it can be adapted to various flow conditions including both high flue gas temperatures, at which the danger of high-temperature corrosion is the greatest, and relatively low flue gas temperatures, at which the danger of low-temperature corrosion is the greatest.

Referring to the following description, the present invention is described in detail, with reference to the appended drawings.

DETAILED DESCRIPTION OF THE PREFERRED EMBODIMENTS

Figure 1:
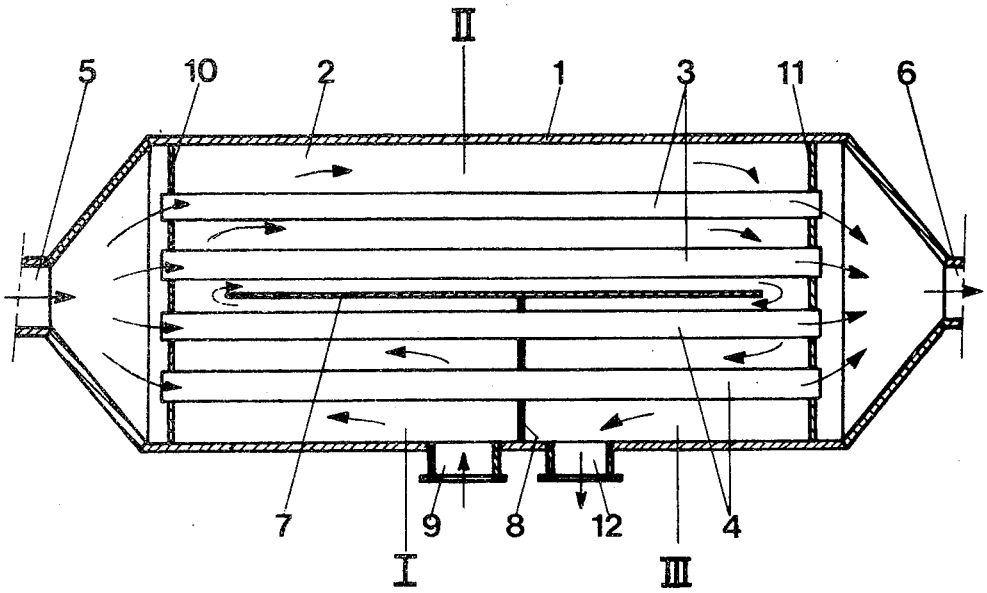
FIG. 1 is an elevation view in section, illustrating the operation of the present invention.

Referring to FIG. 1, the heat exchanger comprises an outer jacket 1, which encloses a space 2 containing a number of flow tubes 3, 4. The flow tubes are connected at one end to the central inlet 5 for the one medium, which in the following is assumed to be the warm medium in the form of flue gases, while at the other end they are connected to the outlet 6 for this medium. During operation the indicated medium is distributed over and flows through the tubes between the inlet and outlet. The flow is indicated by arrows.

The space 2 in the outer jacket is divided into three sections, which are separated from one another by an inner jacket 7 placed parallel to the outer jacket, and by a wall 8 connecting the inner and outer jackets. The inner jacket 7 separates the tubes 3 from the remaining tubes 4 in space 2, and the wall 8 is provided with apertures through which the tubes 4 extend.

Mainly to prevent high-temperature corrosion, the medium surrounding the flow tubes (assumed in the following to be the cold medium) is introduced into the space 2 through an inlet 9 which is located in the outer jacket close to the wall 8 at an axial distance from the end walls 10, 11 which secure the tubes 3,4, said end walls defining the active heat-transferring section of the heat exchanger.

The cold medium initially enters the first section I, in which the counterflow principle or mode of heat transfer is employed in relation to the medium in the tubes 4, and flows in the direction of the end section of the heat exchanger where it flows around the edge of the inner jacket 7 and then between this jacket and the end wall 10 into the second section II. In this section the parallel flow or mode of heat transfer principle is employed in relation to the medium in the tubes 3, and the medium surrounding the tubes flows axially to the other end wall 11 of the heat exchanger where it flows around the opposite edge of the inner jacket 7 and then between this jacket and the end wall 11 into the third section III. There the counterflow principle is again employed in relation to the medium in the tubes 4 and the medium surrounding the tubes finally flows through the outlet 12, which is located close to the wall 3 on the side opposite to inlet 9. As illustrated in FIG. 1, tubes extending through region (or section) I have start and finish flow portions 3*a* and 3*b*, as regards the flow of the first medium therethrough, with start-flow portions 3*a* near inlet end wall 10 and finish-flow portions 3*b* near transverse wall 8. For producing the counter-flow heat transfer in this region, the inlet means 9 to region I for the flow of the second medium is near the finish-flow portions 3*b* of the tubes in this region while the outlet means for region I is near the start-flow portions 3*a* of the tubes, and a similar structure prevails in region III. In region II the tubes have start and finish flow portions 3*c* and 3*d*, and the inlet and outlet means to this region for the flow of the second medium and are near the start and finish parts, respectively, for providing said parallel flow heat transfer.

In this way, the entire quantity of the colder medium flows only around a portion of the flow tubes for the warm medium. This means that when using the heat exchanger to heat combustion air for an industrial furnace with the aid of its flue gases, the air in section I cools the flue gases flowing through the tubes located in this section and in section III down to a temperature which allows heating of the air in section III close to the limit for high-temperature corrosion. Since the entire quantity of air in sections I, II and III flows only around some of the flow tubes for the flue gas, the temperature in section I is increased by an amount considerably smaller than that by which the temperature of the flue gases is lowered. Accordingly, on exiting from section I, the entire quantity of air, at a sufficiently low temperature, encounters that portion of the flue gases which is introduced into the flow tubes of sections I and II at the highest temperature. In section II, the heat is utilized according to the parallel flow principle, as a result of which the temperature of the tubes can be held almost constant at a value approximately equal to that at the inlet to this section. The flue gases enter section III at a temperature lower than the initial temperature and are now cooled even further. By properly distributing the number of tubes over sections I, II and III, as well as by properly locating the wall 8 between the end walls 10 and 11, such conditions can be created that high-temperature corrosion can definitely be prevented even when the quantities of gases fluctuate within broad limits.

If mainly low-temperature corrosion in the heat exchanger is to be prevented, the cold medium is simply fed in the opposite direction, i.e. first through section III using the parallel flow principle, then through section II using the counterflow principle and finally through section I using the counterflow principle.

Figure 2:
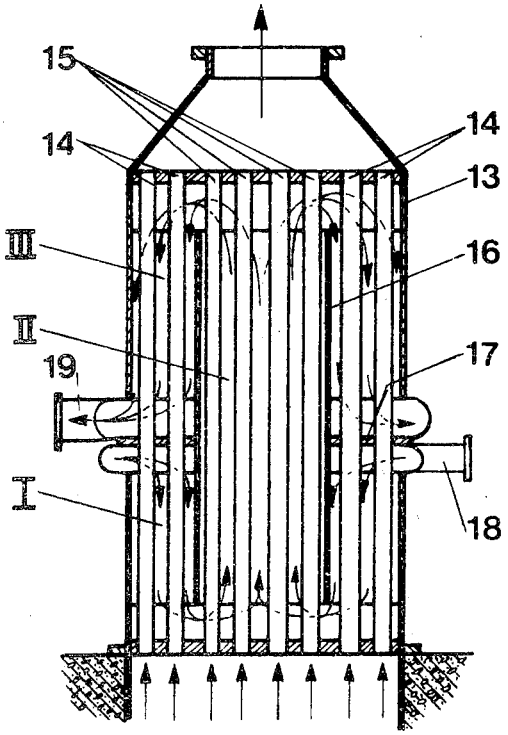
FIGS. 2 and 3 show longitudinal and transverse cross-section views respectively through another embodiment of the heat exchanger in accordance with the present invention.
Figure 3:
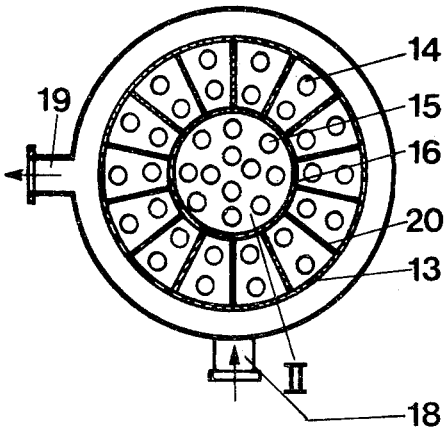

FIGS. 2 and 3 show a longitudinal and transverse cross-section respectively through an advantageous embodiment of a heat exchanger in accordance with the present invention. The outer jacket 13 consists of a cylindrical pipe which encloses the flow tubes 14, 15, and the inner jacket 16 consists of a pipe concentric with the outer jacket and encloses the flow tubes indicated with 15. The inner and outer jackets are connected to one another by a wall 17 which divides the annular space between them, said wall being provided with apertures through which the flow tubes 14 extend. The inner jacket 16 and wall 17 divide the space within the outer jacket 13 into three sections, which are indicated with I, II and III, wherein section II is enclosed by inner jacket 16. The inlet and outlet for the medium surrounding the flow tubes are designated with 18 and 19 respectively.

As in FIG. 1, the flow of the various media is indicated by arrows. The principle of operation of the heat exchanger is likewise analogous to that described in FIG. 1. To provide better directional control of the flow of the medium surrounding the tubes 14, the outside of the inner jacket or, if necessary, the inside of the outer jacket can be provided with flow-directing vanes running longitudinally. This assures that the medium flowing around the flow tubes is always distributed over the cross-section of the heat exchanger when passing through the three sections, thus improving the heat transfer.

If the heat exchanger is to be connected to a furnace whose flue gases have a very high temperature before entry into the heat exchanger, or, if for the purpose of energy utilization, the gases are to be cooled to a lower temperature than that attainable by using the combustion air, the inner jacket and, if necessary, the flow-directing vanes can be covered completely or partially with channels for the purpose of water cooling. The cooling water can, in turn, be used for heating rooms, for example.

The embodiment of the heat exchanger in accordance with the above description means that this heat exchanger can be assembled using relatively easily manufactured components such as tubing and sheeting, and that assembly can be carried out in a simple manner. To match the various temperature and flow conditions, the location of the inlet and outlet for the medium surrounding the flow tubes can be selected practically anywhere along the entire active length of the heat exchanger without requiring essential modifications in the shape of the components of the latter.

If the following data per assumed, the following example results for the appropriate dimensions of a heat exchanger in accordance with the present invention: An oil-fired furnace at a temperature of 1000° C. supplies 1600 $stm^3/h$ (standard cubic meter per hour) of flue gas. The heat content of the flue gases is intended to be utilized to heat 1400 $stm^3/h$ of combustion air from 0° C. to 500° C. It is assumed that the surface temperature of the surfaces contacted by the flue gases is at most the average temperature between the flue gases and air concerned.

For a heat exchanger in accordance with FIG. 2 with flow conditions in accordance with the arrows shown in the figure, and with gas and air velocities selected such that a heat transfer coefficient of 35 $W/m^2.K$ can be assumed, the result is that the outgoing gases have a temperature of 625° C., that the heat transfer surfaces are approximately 4 $m^2$ in section I, approximately 8.5 $m^2$ in section II, and approximately 4.5 $m^2$ in section III, if the lowest temperature on the flow tubes is to be more than approximately 150° C. and the highest temperature on these tubes is to be less than approximately 600° C.

What we claim is:

1. In a heat exchanger for heat transfer between first and second mediums, the heat exchanger including a plurality of generally parallel tubes for flow therethrough of said first medium through said tubes and an outer jacket formed by walls surrounding and defining therein a heat transfer space for said second medium to flow about and in contact with said tubes which extend through said heat transfer space and through the jacket walls, the improvement in combination therewith comprising wall means dividing said heat transfer space into three regions, designated I, II and III, through which said tubes extend, the tubes which extend through region I being the same tubes extending through region III, said wall means comprising a first wall portion extending substantially parallel to said tubes and substantially region II from regions I and III said first wall portion having opposite ends each extending toward but spaced from one of said jacket walls, and a second wall portion extending transversely from said first wall portion to said jacket wall and separating region I from region III, said improvement further comprising fluid inlet and outlet means in each of said regions for establishing a direction of second medium flow through each region and for forming a continuous passage from region I to II to III, said tubes being oriented in said regions such that the direction of first medium flow in the tubes is (a): in regions I and III generally opposite the flow direction of the second medium through this region, producing counter-flow heat transfer therebetween, and (b) in region II generally the same as the flow direction of the second medium in this region, producing parallel flow heat transfer therebetween.

2. A heat exchanger according to claim 1 wherein said tubes in each region have start and finish flow portions as regards the flow of said first medium therethrough, said inlet and outlet means for the second medium in each of said regions I and III are near the finish and start flow portions, respectively of the tubes extending through said regions, and said inlet and outlet means for second medium in region II are near the start and finish flow portions, respectively, of said tubes extending through said region.

3. Apparatus according to claim 1, wherein regions I and III comprise substantially equal volumes, and the sum of these volumes is substantially equal to the volume of region II.

4. A heat exchanger according to claim 1, wherein said outer jacket comprises a generally cylindrical shape, said wall means defines an inner jacket formed also as a cylinder and concentric within said outer jacket defining an annular space therebetween, and said wall means further comprises a transverse wall extending in said annular space between and connecting said inner and outer jackets, wherein region II is within said inner jacket, and regions I and III are in said annular space on opposite sides of said transverse wall.

5. A heat exchanger according to claim 1, wherein said outer jacket comprises central inlet means having a first part for receiving a flow of said first medium, and a second part for distributing said flow to all of said tubes in communication with said inlet means.

6. A heat exchanger according to claim 1, wherein said outer jacket comprises end walls and side walls extending between said end walls with said tubes extending generally parallel and lengthwise between said end walls, said wall means comprises a first wall extending lengthwise in said heat exchange space and having opposite ends, each end spaced from one of said end walls for defining flow passages between regions, said second wall portion extending from said first wall to at least one of said side walls, wherein region I is defined between parts of said inlet end wall, the transverse wall, the first wall, and a side wall, region III is defined between parts of said outlet end wall, the transverse wall, the first wall and a side wall, and region II is defined between parts of said end walls, said jacket, side wall and the lengthwise wall.

7. A heat exchanger according to claim 6, wherein said transverse wall is generally midlength of said jacket between said end walls.

8. A heat exchanger according to claim 4, further comprising means for water-cooling said inner jacket.

9. In a heat exchanger for heat transfer between first and second mediums, the heat exchanger including a plurality of generally parallel tubes for flow therethrough of said first medium and an outer jacket formed by walls surrounding and defining therein a heat transfer space for said second medium to flow about and in contact with said tubes which extend through said heat transfer spaced through said jacket walls the improvement in combination therewith comprising wall means dividing said heat transfer space into three regions, designated I, II, and III, through which said tubes extend, the tubes which extend through region I being the same tubes extending through region III, said wall means comprising a first wall portion extending substantially parallel to said tubes and substantially separating region II from regions I and III, said first wall having opposite ends, each extending toward but spaced from one of said jacket walls, and a second wall portion extending transversely from said first wall portion to said outer jacket and separating region I from region III, said improvement further comprises fluid inlet and oulet means in each of said regions for establishing a direction of second medium flow through each region and for forming a continuous passage from region III to II to I, said tubes being oriented in said regions such that the direction of first medium flow (a) in the tubes is: in regions I and III generally the same as the flow direction of the second medium through this region, producing parallel flow heat transfer therebetween, and (b) in region II generally opposite the flow direction of the second medium in this region, producing counter-flow heat transfer therebetween.

10. A heat exchanger according to claim 9, wherein said tubes in each region have start and finish flow portions as regards the flow of said first medium therethrough, said inlet and outlet means for the second medium in each of said regions I and III are near the start and finish flow portions, respectively, of the tubes extending through said regions, and said inlet and outlet means for second medium in region II are near the finish and start flow portions, respectively, of said tubes extending through said region.

11. Apparatus according to claim 9, wherein regions I and III comprise substantially equal volumes, and the sum of these volumes is substantially equal to the volume of region II.

12. A heat exchanger according to claim 9, wherein said outer jacket comprises a generally cylindrical shape, said wall means defines an inner jacket formed also as a cylinder and concentric within said outer jacket defining an annular space therebetween, and said wall means further comprises a transverse wall extending in said annular space between and connecting said inner and outer jackets, wherein regions II is within said jacket, and regions I and III are in said annular space on opposite sides of said transverse wall.

13. A heat exchanger according to claim 9, wherein said outer jacket comprises central inlet means having a first part for receiving a flow of said first medium, and a second part for distributing said flow to all of said tubes in communication with said inlet means.

14. A heat exchanger according to claim 9, wherein said outer jacket comprises end walls and side walls exending between said walls, with said tubes extending generally parallel and lengthwise between said end walls, said wall means comprises a first wall extending lengthwise in said heat exchange space and having opposite ends, each end spaced from one of said end walls for defining flow passages between regions, said second wall portions extending from said first wall to at least one of said side walls, wherein region I is defined between parts of said inlet end wall, the transverse wall, the first wall, and a side wall, region III is defined between parts of said outlet end wall, the transverse wall, the first wall and a side wall, and region II is defined between parts of said end walls, a side wall and transverse wall.

15. A heat exchanger according to claim 14, wherein said transverse wall is generally midlength of said jacket between said end walls.

16. A heat exchanger according to claim 12, further comprising means for water-cooling said inner jacket.

* * * * *

UNITED STATES PATENT AND TRADEMARK OFFICE

CERTIFICATE OF CORRECTION

PATENT NO. : 4,147,209

DATED : 4-3-79

INVENTOR(S) : A.K.Persson

It is certified that error appears in the above-identified patent and that said Letters Patent are hereby corrected as shown below:

Column 2, line 10 - Change "leding" to --leading--.

Column 2, line 33 - Change "an" to --a--.

Column 2, line 67 - After "jacket", second occurrence, add --1--.

Column 3, line 28 - Change "3" to --8--.

Column 4, line 63 - Change "per" to --are--.

Column 5, line 33 - After "stantially" insert --separating--.

Column 5, line 44 - Omit "(a):" and insert -- :(a) --.

Column 6, line 14 - After "said" insert --jacket--.

Column 6, line 17 - After "said" insert --jacket--.

UNITED STATES PATENT AND TRADEMARK OFFICE

CERTIFICATE OF CORRECTION

PATENT NO. : 4,147,209

DATED : 4-3-79

INVENTOR(S) : A.K.Persson

It is certified that error appears in the above-identified patent and that said Letters Patent are hereby corrected as shown below:

Column 6, line 20 - After "said" insert --jacket--.

Column 6, line 21 - After "said' insert --jacket--.

Column 6, line 22 - After "a" insert --jacket--.

Column 6, line 23 - After "said" insert --jacket--.

Column 6, line 24 - After "a" insert --jacket--.

Column 6, line 25 - After "said" first occurrence, insert --jacket--.

Column 6, line 25 - After "jacket" omit ",".

Column 6, line 39 - After "walls" omit ",".

UNITED STATES PATENT AND TRADEMARK OFFICE

CERTIFICATE OF CORRECTION

PATENT NO. : 4,147,209
DATED : 4-3-79
INVENTOR(S) : A.K. Persson

It is certified that error appears in the above-identified patent and that said Letters Patent are hereby corrected as shown below:

Column 6, line 57 - Omit "(a)".

Column 6, line 57 - After "Tubes is:" insert --(a)--.

Column 7, line 18 - Change "regions" to --region--.

Column 7, line 19 - Before "jacket" insert --inner--.

Column 8, line 5, After "said" insert --end--.

Column 8, line 11, Change "portions" to --portion--.

Column 8, lines 17-18 - Delete "a side wall and transverse wall" and insert --said jacket side wall and said first wall extending lengthwise--.

Signed and Sealed this

*Twenty-second* Day of *January 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4,147,209

DATED : April 3, 1979

INVENTOR(S) : A.K.Persson

It is certified that error appears in the above-identified patent and that said Letters Patent are hereby corrected as shown below:

Col. 6, line 12 - After "comprises" insert --inlet and outlet--.

Col. 6, line 39 - Change "spaced" to --space and--.

Col. 6, line 39 - After "walls" insert --,--.

Signed and Sealed this

*Third* Day of *June 1980*

[SEAL]

*Attest:*

SIDNEY A. DIAMOND

*Attesting Officer*

*Commissioner of Patents and Trademarks*